United States Patent [19]

Audet et al.

[11] 4,191,028

[45] Mar. 4, 1980

[54] DRY ICE, LIQUID PULSE PUMP COOLING SYSTEM

[75] Inventors: Norman F. Audet, Southboro; George M. Orner, Cochituate, both of Mass.

[73] Assignee: United States of America as represented by the Secretary of the Navy, Washington, D.C.

[21] Appl. No.: 918,203

[22] Filed: Jun. 22, 1978

[51] Int. Cl.[2] ..... A25D 23/12; A62B 7/00

[52] U.S. Cl. ..... 62/259

[58] Field of Search ..... 62/96, 98, 99, 165, 62/384, 386, 259 B, 406; 128/142.5

[56] References Cited

U.S. PATENT DOCUMENTS

| | | | |
|---|---|---|---|
| 3,500,827 | 3/1970 | Paine | 62/259 B |
| 3,526,102 | 9/1970 | Boylett et al. | 62/259 B |
| 3,869,871 | 3/1975 | Rybalko et al. | 62/259 B |

*Primary Examiner*—Lloyd L. King

*Attorney, Agent, or Firm*—R. S. Sciascia; L. I. Shrago; C. E. Vautrain, Jr.

[57] ABSTRACT

A $CO_2$-powered system for cooling garments by conduction cooling when the wearer is subjected to heat stress is provided. A dry ice refrigerant source provides the cooling and the $CO_2$ gas given off during sublimation of the dry ice provides the motive power for a diaphragm type pump which transports heat transfer liquid between the heat source and the refrigerant or heat sink. The system may be interfaced with brine type cooling systems used for food preservation to maintain food temperatures under emergency conditions such as power outages due to its non-electrical energy source.

15 Claims, 5 Drawing Figures

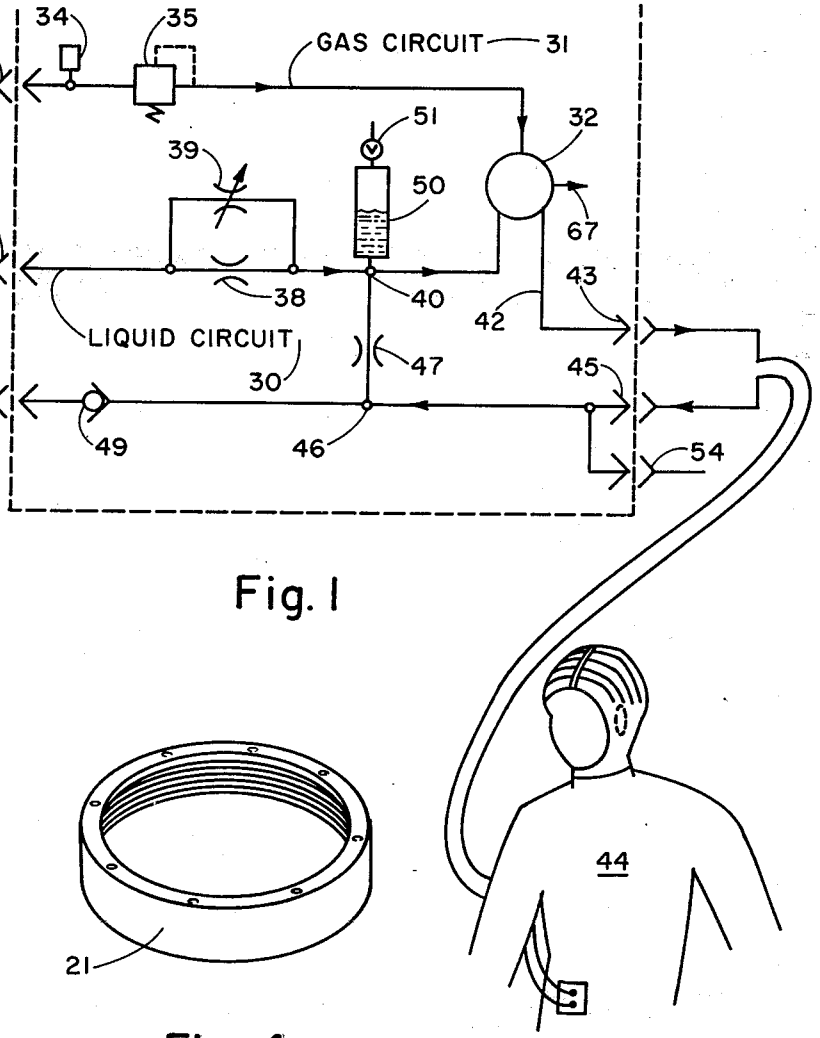
Fig. 1
Fig. 4
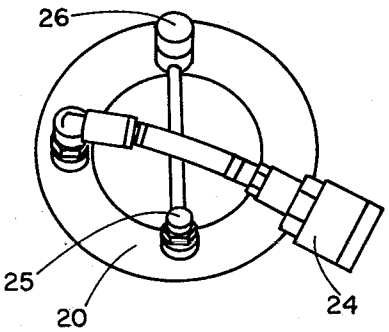
Fig. 3
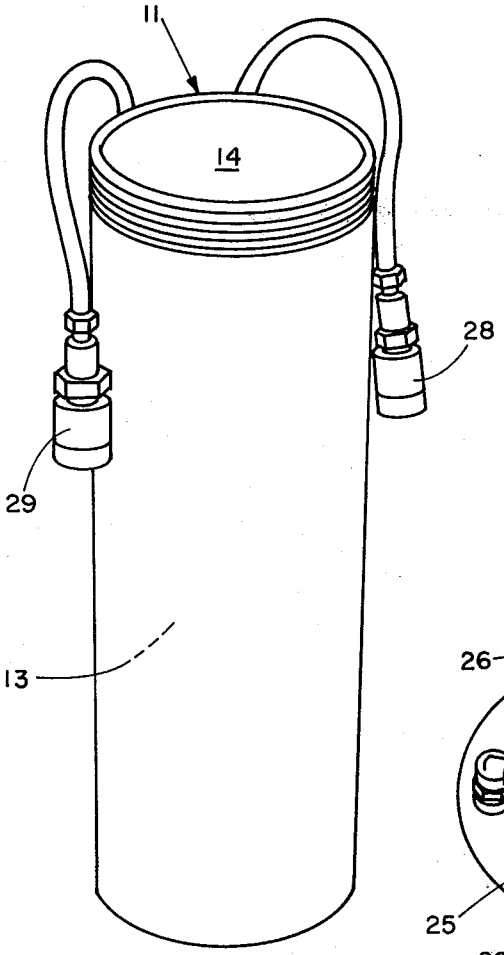
Fig. 2

DRY ICE, LIQUID PULSE PUMP COOLING SYSTEM

The present invention concerns garment cooling systems and, more particularly, a system for providing conduction cooling to individuals when subjected to conditions of heat stress.

Clothing cooling system are desirable in many situations where heat stress to personnel is known to occur. Crash-crew firefighters can be debilitated by heat when dressed in their turnout clothing during runway standby operations in warm climates so that their ability to perform effectively in emergency fire conditions occurring during this time would be doubtful. Other personnel dressed in impermeable protective clothing and required to perform multiple duties under all climatic conditions are also prime heat stress candidates whose capabilities are extremely limited if no effective body cooling systems are available. Various existing means for cooling such personnel include the use of a heat transfer fluid in personnel conduction cooling systems and generally require a separate energy source such as batteries to transport the heat transfer liquid from the body heat source to the refrigerant heat sink by electrically driven pumps. Dependency on batteries makes these systems unreliable and cumbersome. The previous cooling means also include a device specifically directed to the use of dry ice as both the refrigerant and energy source for transferring a heat transfer liquid between the heat source and the heat sink. This particular device, however, is believed to be ineffective because it employs a float system to control the flow of liquid which is overly dependent on the orientation of the system, it loses cooling power rapidly once the dry ice has sublimated away from the storage container walls, and the heat transfer fluid reservoir must be coupled directly to the dry ice storage container thereby limiting packaging flexibility. The present invention also uses dry ice as both the refrigerant and power source, but it avoids the losses of previous systems by providing effective heat transfer between the heat transfer liquid and the dry ice, among other distinctions.

Accordingly, it is an object of the present invention to provide a garment cooling system in which the energy of the refrigerant is effectively used to power the device.

Another object of this invention is to provide a garment cooling system using dry ice as the refrigerant which is adaptable to interface with brine type cooling systems employed in food preservation under emergency conditions such as when power outages occur.

A further object of this invention is to provide a garment cooling system in which the sublimated gas provides system power through use of a diaphragm pump and the system components are separated to increase packaging effectiveness.

Other objects, advantages and novel features of the invention will become apparent from the following detailed description thereof when considered in conjunction with the accompanying drawings in which like numerals represent like parts throughout and wherein:

FIG. 1 is a schematic diagram of one embodiment of the invention;

FIG. 2 is a perspective view of the integral dry ice storage and heat exchange canister of the invention;

FIG. 3 is a perspective view of the plug cover for the canister;

FIG. 4 is a perspective view of the plug cover retaining ring; and

Figure 5:
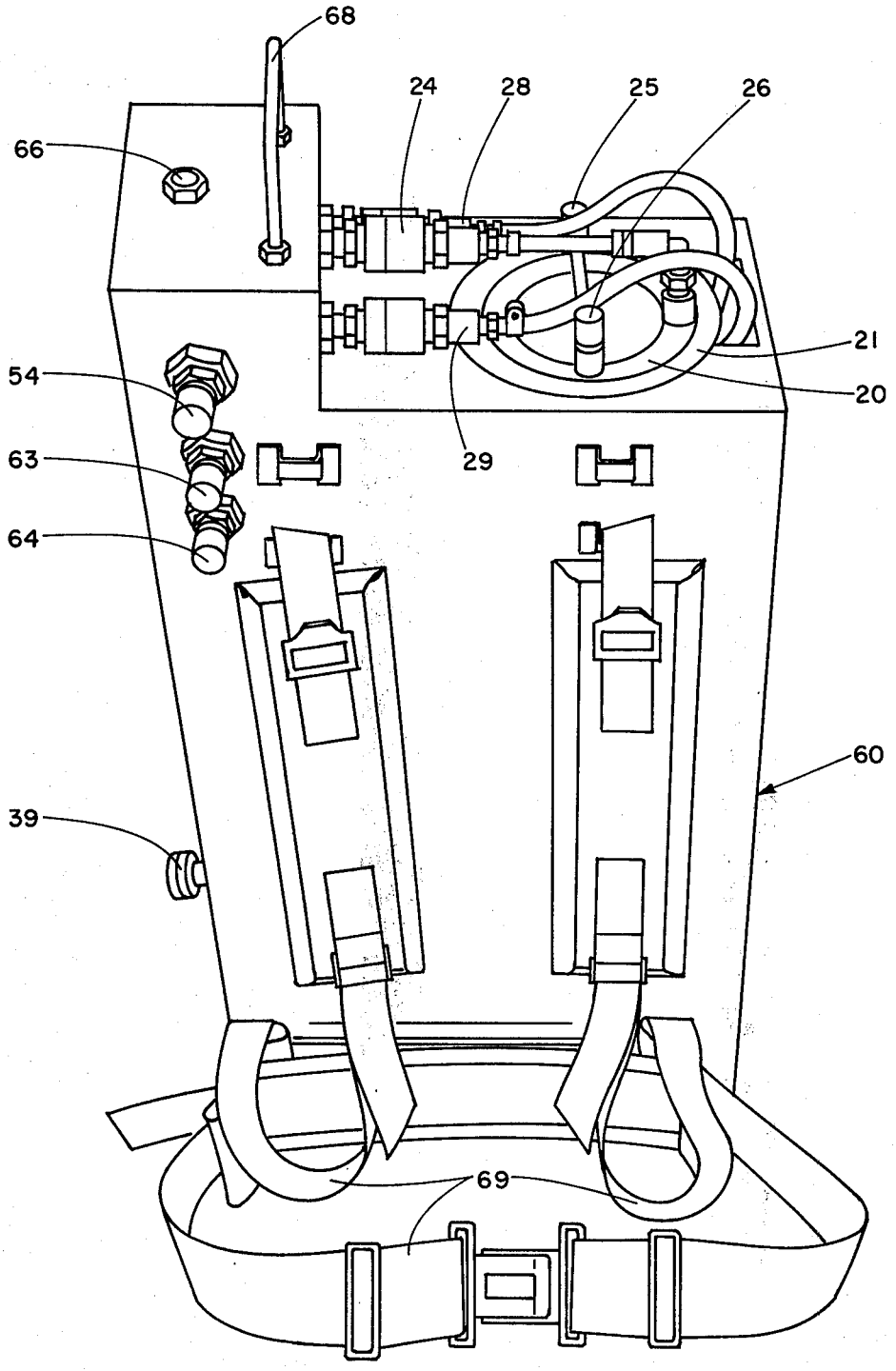
FIG. 5 is a perspective view showing the invention assembled for carrying or backpacking while connected to a garment adapted to be liquid cooled.

The present invention, in general, concerns a system for cooling garments using dry ice as the refrigerant source and the $CO_2$ gas given off in the sublimation of the dry ice to operate a liquid circulating pump which, through flow-control valves, check valves, etc., circulates heat transfer liquid between the body heat source and the heat exchanger. The liquid circuit permits only a fractional amount of the liquid returning from the liquid cooling garment to pass through the heat exchanger, the bulk of the liquid supply circulating between the pump and the garment. The liquid that does pass through the heat exchanger is mixed with the circulating liquid near the pump, and the amount mixed is controlled to achieve a temperature level acceptable for human comfort.

Referring to the drawings, FIG. 1 shows the cooling system schematically and includes an integral dry ice container and heat exchange canister 11 which is double-walled circumferentially and at its bottom to form a heat exchanger 13 and is shown in greater detail in FIG. 2. The canister may be constructed of welded aluminum from aluminum fin stock material or other similar material and is baffled to insure a flow of liquid down one side, across the bottom, and up the other side. The inner volume of the canister provides a cylindrical cavity 14 in which dry ice preferably in block form as indicated at 16 is placed to act as both the heat sink and the motive power for the system. Canister 11 is contained in a cylindrical housing 17 which may be fabricated from aluminum or other metal and may be insulated with polyethylene vinyl acetate foam or other insulation to minimize heat gain from the environment. Cavity 14 is closed by a plug cover 20, shown in FIG. 3, and sealed by an O-ring, not shown, and a retaining ring 21 shown in FIG. 4. Cover 20 is provided with a $CO_2$ gas-outlet quick coupler 24, a relief valve 25 and a safety valve 26, while heat exchanger 13 is provided with an inlet circuit quick coupler 28 and an outlet circuit quick coupler 29 for connection to a liquid circuit 30 of the cooling system of the invention.

Referring again to FIG. 1, the system includes liquid circuit 30 and a gas circuit 31 which connects cavity 14 to a suitable pump such as a gas-operated liquid-pulse pump 32 via quick coupler 24, a pressure relief valve 34 that is set to open at 3 atm and a pressure regulator 35 whose function is to maintain a constant gas input to pump 32 and is normally set to operate to 2.67 atm. Pump 32 has a single diaphragm and requires that liquid circuit 30 be statically pressurized to operate properly. Circuit 30 provides for flow of a heat transfer liquid or coolant, which may be a 70% solution of methyl alcohol in water by weight, from heat exchanger 13 through coupling 28 and an orifice 38, which is connected in parallel to a user operated flow control valve 39, and thence to pump 32 via a four-way junction 40. Junction 40 provides for mixing of liquid from the heat exchanger with liquid circulating in a loop 42 which conducts liquid from pump 32 through an inlet quick coupler 43 to heat transfer liquid passages, not shown, in a liquid cooling garment 44 thence through an outlet quick coupler 45 and a three-way junction 46 back to junction 40 through an orifice 47. Junction 46 returns part of the coolant to the heat exchanger via a check valve 49, which prevents back flow of liquid from the heat exchanger, and coupler 29. An accumulator and liquid reservoir 50 having a bleed valve 51 connected thereto is used in conjunction with an auxiliary connection 54 to prime the system with liquid, pressurize the system to the desired liquid level in the accumulator, and drain the system.

FIG. 5 shows the major components of the garment cooling system assembled in a carrying case 60 which is provided with heat transfer liquid couplings 63 and 64 for supply to and return from garment 44 through external couplings and tubing, not shown, refill and drain coupling 54, and an auxiliary relief valve 66 for relieving excess pressure in case 60. The excess pressure results from an accumulation of the gas that leaks from pump 32 through a valve indicated at 67 in FIG. 1. The case also includes a carrying handle 68 and a harness assembly 69 so that it may be mounted as a backpack or carried in suitcase form. Pump 32 may be any suitable commercially available pump and preferably is positioned inside case 60 adjacent to flow control valve 39. A diaphragm-type pump is preferred because of compactness and ability to operate at relatively high pressures on the order of 3 atm.

Initially, the dry ice container/heat exchanger, which can easily be placed in or removed from housing 17, is attached to the system liquid and $CO_2$ gas circuits through the quick couplers on the case. Any suitable liquid cooling garment is also attached to the system liquid circuit by other similar quick couplers. Manual flow control valve 39 on the side of the case varies the amount of heat transfer liquid passing through the heat exchanger. In pump operation, $CO_2$ gas entering one side of the diaphragm in the pump gas cavity discharges liquid from the pump liquid cavity as the diaphragm is expanded. Check valves on the inlet and-outlet pump liquid connections establish the flow direction. The gas exhaust valve seal is part of the diaphragm assembly and does not open the exhaust until the diaphragm is fully expanded. The exhaust is closed by the relaxation of the diaphragm as liquid reenters the pump liquid cavity during the return cycle. To limit the amount of $CO_2$ gas lost before the exhaust valve closes, the valve employed at 67 is a normally spring opposed diaphragm-controlled inlet valve. Pressure in the pump gas cavity acting on the inlet valve diaphragm working against the spring keeps the valve open during the pump cycle. When the pressure in the pump gas cavity is reduced substantially as the exhaust valve opens, the spring force overcomes the gas pressure on the inlet valve diaphragm and the gas valve inlet closes. When the exhaust valve recloses during the liquid return cycle, a small controlled gas leak by the inlet valve reapplies pressure to the inlet valve diaphragm, reopening the inlet valve.

In operation, the entire liquid system including heat exchanger 13, liquid circuit 30, pump 32 and the conduits in garment 44 is charged with liquid through fill and drain coupling 54, preferably using a commercially available aspirator type hand pump, to a predetermined pressure of substantially 15 psig. Bleed valve 51 is opened until a portion of reservoir 50 is filled with liquid and then closed to allow the liquid system to be pressurized. Integral heat exchanger/dry ice container 11 is then disconnected from the system and filled respectively with, in the preferred embodiment, 25 cc of liquid methyl alcohol/water solution and a 10-lb block of dry ice for a cooling capacity of 2700 Btu, and allowed to stand until container pressure relief valve 25 is actuated which insures that there is adequate pressure in container 11, i.e. on the order of from 25 to 30 psig, to operate pump 32. The time required for pressure to build up under these conditions is less than 10 minutes. Integral container 11 is then reconnected to the system and pump 32 immediately will begin to pump liquid to the garment liquid conduction cooling device when it is connected to the system.

Liquid flows through the system as indicated by the arrows in FIG. 1, with liquid temperature control being achieved by externally positioned flow control valve 39. The highest temperature is achieved with valve 39 closed, and regulation of this valve permits dissipation in the preferred embodiment of heat at rates of up to 1,000 Btu/hour until substantially 90% of the dry ice charge is dissipated. With valve 39 closed, orifice 38 allows sufficient liquid flow to heat exchanger 13 to generate sufficient gas for pump operation. Heat inputs as low as 500 Btu/hour are sufficient to achieve an adequate pump output flow rate. This is easily realized from a basal personnel output of substantially 360 Btu/-hour in conjunction with a heat leak through housing 17 from the atmosphere of substantially 200 Btu/hour. When the dry ice charge is dissipated, its container can be disconnected from the system and the system can be refilled for reuse or another fully charged container 11 can be substituted for continued operation. The system is drained of liquid with a hand pump only when it is being permanently stowed.

Normally, all system components are always charged with liquid when the system is operational. At some point in time during system operation the sublimating dry ice no longer touches the container side surfaces and is enveloped by the low thermal conductivity $CO_2$ gas being evolved. Both of these actions limit heat transfer between the dry ice and the heat transfer liquid in the vertical side surfaces. As this stage, however, the bottom surface of the dry ice container remains in contact with both the dry ice and the heat transfer liquid, i.e. through the container wall. Also, the $CO_2$ gas evolved at the bottom surface of the dry ice container is bubbled through the liquid solution in the container, providing a good heat transfer connection between the bottom heat exchanger area and the dry ice at all times. This heat transfer means insures proper operation of the system until most of the initial dry ice charge is spent. Accumulator and liquid reservoir 50 reduces system pressure fluctuations and overcomes losses in system static pressure that may occur because of smal leaks that exist when canister 11 and liquid cooling garment 44 are coupled to the case. Pressure relief valve 34 is a backup safety for pressure relief valve 25, and both are set preferably at 3 atm. Safety valve 26 will relieve canister 11 gas pressure in the event the two pressure relief valves fail.

There is thus provided a garment cooling system in which the refrigerant source is used as both the cooling medium and to transport the heat transfer medium. The effective heat exchange built into the system between the dry ice and the heat transfer medium permits large dissipation rates on the order of 2,000 Btu/hour with dry ice. The inventive concept also permits effective packaging of components and does not make the system dependent on orientation of its components for proper operation. The system of the invention can be used as an emergency cooling system with brine type cooling cabinets employed to protect food products from spoiling during power outages as well as for cooling personnel under situations where stress occurs.

Obviously many modifications and variations of the invention are possible in the light of the foregoing teachings. For example, in lieu of the diaphragm type pump a piston type gas operated pump or other similar device may be employed with the system. Any such alternate pump should have a light enough volumetric efficiency to operate within the limits of the $CO_2$ gas available and be able to operate at the pumping pressures required. The configuration of the dry ice canister may be varied so long as it can withstand the operating pressure and provide a good thermal connection between the dry ice and the heat transfer medium. The heat transfer medium may be other than the methyl alcohol/water mixture described so long as the substitute fluids have a low enough freezing point to be utilized with the dry ice, whose sublimation temperature at atmospheric pressure is −110° F., to prevent freezing of the liquid in the heat exchanger during non-pumping periods.

What is claimed is:

1. A garment cooling system for cooling personnel such as when subject to heat stress comprising:

means combining a receptacle for refrigerant material and a liquid heat exchanger to provide the heat sink and motive power of said system;

a gas operated pump coupled to said receptacle and a liquid cooled garment coupled jointly to said pump and said heat exchanger to form a liquid circuit for continuously supplying heat exchange liquid to said garment, said liquid circuit including means for limiting flow to one direction therein and fixed and variable flow control means in said circuit for permitting a minimum unidirectional flow therein and additional flow respective to demand from the wearer;

a liquid accumulator connected to said circuit for maintaining liquid under selected pressure therein;

pressure release means connected to said receptacle for limiting the pressure therein and vent means connected to said accumulator for adjusting the pressure in said circuit; and a sublimating refrigerant material in said receptacle and liquid heat transfer material in said heat exchanger and said circuit, whereby gas sublimating from said refrigerant material will operate said pump and said pump will circulate heat transfer material in said circuit thereby supplying a cooling medium for dissipating a selected amount of excess heat emanating from the wearer of said garment.

2. The system as defined in claim 1 wherein said pump and said receptacle are in a gas circuit and a pressure regulator in said gas circuit for maintaining a constant gas input to said pump.

3. The system as defined in claim 2 wherein said garment and said pump are directly coupled in a loop to circulate a constant flow of heat transfer material to said garment and said circuit is a liquid circuit for adding a selected amount of chilled liquid to said loop.

4. A portable device for connection to and cooling of liquid cooled garments having conduction cooling conduits comprising:

a gas operated pump and means conducting the gas from a sublimating refrigerant material to said pump;

a refrigerant material receptacle having a supply of refrigerant material therein and a heat exchanger cooled by said refrigerant material and having a heat exchange medium therein;

conduit means interconnecting said heat exchanger, said pump and said garment and means maintaining a pressurized supply of said heat exchange medium in said conduit means, said conduit means having an orifice for permitting a minimum flow rate of heat exchange medium from said heat exchanger to said pump to maintain pump operation and flow control means in parallel with said orifice for permitting an increased flow rate from said heat exchanger to said pump in response to demand by personnel wearing said garments; and means in said conducting means for maintaining a substantially constant gas pressure to said pump, whereby the device may be readily charged with refrigerant material and heat exchange medium and connected to liquid cooled garments prior to expected conditions of heat stress.

5. The device as defined in claim 4 wherein said conduit means include a first circuit for returning medium in a unidirectional flow to and drawing medium from said heat exchanger and a second circuit for circulating a major flow rate of medium between said pump and said garments, said first and second circuits having a common branch for accommodating said major flow rate, returning a portion of said medium to said heat exchanger, and admitting cooled medium drawn from said heat exchanger.

6. The device as defined in claim 5 wherein said receptacle and said heat exchanger are combined in a double-walled canister having a central cavity for receiving said refrigerant material.

7. The device as defined in claim 6 wherein said canister is a cylinder open at one end and having an interior space formed to receive medium at an inlet coupling adjacent the top and direct flow downward then across the bottom then upward to an outlet coupling adjacent the top and remote from said inlet coupling;

a cover and a cover retaining ring for sealing said cavity, said cover including a coupling for connection to said gas conducting means, said inlet, outlet and cover couplings being quick connect couplings to facilitate connection to said garments.

8. The device as defined in claim 7 and further including a carrying case for receiving said canister, said pump and said conducting and conduit means;

coupling and conduit means in said carrying case for connection of said quick connect couplings; and external male couplings in said case connecting said first and second circuits to said liquid cooled garments and for filling and draining said conduit means.

9. The device as defined in claim 8 wherein said pump is a diaphragm pump having a gas exhaust valve operable only when the diaphragm of said pump is substantially fully extends and a seal closed by relaxation of the diaphragm to reduce gas loss, said valve spring biased to overcome the pressure in said conducting means as the valve opens, said valve including means permitting a controlled gas leak to reapply pressure to said diaphragm and reopen said valve.

10. The device as defined in claim 9 wherein said means maintaining a pressurized supply of heat exchange medium is an accumulator having vent means for adjusting the pressure in said conduit means and said garments; and individual pressure release means in said cover, said gas conducting means and said carrying case for limiting the pressures in said cavity, said conducting means and said carrying case, respectively, said first circuit forming a first loop which includes in sequence a supply line for drawing medium from said heat exchanger, said outlet quick coupling, said orifice and said flow control means, said common branch, unidirectional flow control means, said inlet quick coupling, and return line to said heat exchanger, said second circuit forming a second loop which includes said common branch, said pump, an inlet quick coupling and supply line to said garments, and an outlet quick coupling and return line from said garments, said accumulator connected to the juncture of said common branch and said first loop, said male coupling connected to said second loop adjacent said outlet quick coupling; and a fill and drain quick coupling means connected to said male coupling.

11. Portable apparatus for connection to liquid cooling garments to provide cooling to personnel subjected to heat stress comprising:

an integral dry ice canister and heat exchanger assembly and means insulating the exterior thereof;

a gas-operated pump and means connecting said pump to said canister and heat exchanger assembly, said means including a gas circuit between said canister and said pump and a divided liquid circuit interconnecting said heat exchanger, said pump and a liquid cooling garment;

a fill and drain connection in said liquid circuit;

first coupling means in said circuits for detaching said integral assembly therefrom;

second and third coupling means in said liquid circuit for connecting said garment and said fill and drain connection respectively thereto;

a liquid reservoir and means connecting said reservoir to said liquid circuit;

a supply of dry ice in said canister and a selectively pressurized supply of heat exchange liquid in said liquid circuit and the cooling conduits in said garment;

control means providing a variable undirectional flow of liquid through said heat exchanger in one portion of said liquid circuit and a major flow rate of liquid between said pump and said garment in another portion of said liquid circuit; and pressure relief means for controlling the pressures in said circuits, whereby said apparatus may be charged with dry ice and heat exchange liquid a brief time on the order of 8 to 10 minutes before connection to a garment for use in cooling the wearer during expected heat stress conditions.

12. The apparatus as defined in claim 11 wherein said pump is a diaphragm pump having a gas exhaust valve operable only when the diaphragm of said pump is substantially fully extended and a seal closed by relaxation of the diaphragm to reduce gas loss.

13. The apparatus as defined in claim 11 wherein said divided liquid circuit includes a common branch between two circuits with said reservoir connected to the branch junction on the inlet side of said pump and a check valve between the other junction of said common branch and said heat exchanger; and said undirectional flow control means include parallel connected fixed and variable orifices between said heat exchanger and said reservoir connection to maintain a minimum uncontrolled flow rate to said pump and a controlled variable flow rate thereto as required by the wearer of said garment.

14. The apparatus as defined in claim 13 wherein one of said two circuits forms a first loop which includes in sequency a supply line for drawing liquid from said heat exchanger, said fixed and variable orifices, said common branch, said check valve, and a return line to said heat exchanger, the other of said two circuits forming a second loop which includes in sequence said pump, an inlet circuit to said garment, an outlet circuit from said garment, and said common branch.

15. The apparatus as defined in claim 14 and further including a carrying case for receiving said assembly, said pump and said circuits;

coupling and conduit means in said carrying case for connection to said fill and drain connection and said first, second and third coupling means; and external male couplings in said case for connecting said liquid circuit to said garment.

* * * * *